US007408477B2

(12) United States Patent
Finkle et al.

(10) Patent No.: US 7,408,477 B2
(45) Date of Patent: Aug. 5, 2008

(54) FIRE ALARM PULL STATION WITH AUDIO DETERRENT

(76) Inventors: Louis J. Finkle, 5012 Verdura Ave., Lakewood, CA (US) 90712; Andrea Furia, 7546 Stewart & Gray Rd. #208, Downey, CA (US) 90241

( * ) Notice: Subject to any disclaimer, the term of this patent is extended or adjusted under 35 U.S.C. 154(b) by 209 days.

(21) Appl. No.: 11/231,596

(22) Filed: Sep. 20, 2005

(65) Prior Publication Data

US 2007/0063821 A1 Mar. 22, 2007

(51) Int. Cl.
*G08B 23/00* (2006.01)

(52) U.S. Cl. ..... 340/693.5; 340/628; 340/577; 340/287

(58) Field of Classification Search ..... 340/545.6, 340/545.7, 577, 632, 686.1, 693.5, 825.37, 340/287, 286.06
See application file for complete search history.

(56) References Cited

U.S. PATENT DOCUMENTS 3,253,272 A 5/1966 Schuchard et al.
4,017,844 A 4/1977 Facchini et al.
4,267,549 A * 5/1981 Taylor ..... 340/302
4,551,707 A 11/1985 Simpson
4,638,297 A 1/1987 Roots
4,706,065 A 11/1987 Kovacic et al.
5,760,678 A * 6/1998 Pavlacka et al. ..... 340/287
5,955,939 A * 9/1999 Taylor ..... 340/286.05
6,314,772 B1 11/2001 Hohlfelder
6,380,846 B1 4/2002 Hohlfelder
6,632,108 B1 10/2003 Hohlfelder
6,693,534 B2 * 2/2004 Costa et al. ..... 340/531

* cited by examiner

*Primary Examiner*—Benjamin C. Lee
*Assistant Examiner*—Travis R. Hunnings
(74) *Attorney, Agent, or Firm*—Kenneth L. Green; Edgar W. Averill, Jr.

(57) ABSTRACT

A fire alarm pull station includes a cover which must be opened to reach a fire alarm actuating handle, and an audio pull station alarm triggered by opening the cover. Once triggered, the pull station alarm remains on until reset, which reset requires using a tool in a first embodiment or a key in a second (or key lock) embodiment. The tool or key preferably allows the pull station to be opened to reset the pull station alarm. The cover may further be blocked from closing after being opened, and may only be closed after opening the pull station to reset a blocking mechanism. The pull station alarm is preferably an audio alarm residing in the pull station and the pull station may be hard wired to the fire alarm or wireless. The presence of the pull station alarm serves to deter false alarm setting.

16 Claims, 8 Drawing Sheets

FIRE ALARM PULL STATION WITH AUDIO DETERRENT

BACKGROUND OF THE INVENTION

The present invention relates to pull stations for activating fire alarms and in particular to a pull station with an audio deterrent to reduce false alarm setting.

Fire alarm pull stations are commonly used in public places to provide a means for sounding an alarm when a fire occurs. Unfortunately, pranksters often set off false fire alarms as jokes. The results of such false alarms may be both a disruption of normal activities in the area of the alarm and an unnecessary response by a fire company. Setting a false alarm generally results in a number of local alarm bells sounding, but there is often no immediate effect drawing attention to the activated pull station.

BRIEF SUMMARY OF THE INVENTION

The present invention addresses the above and other needs by providing a fire alarm pull station including a cover which must be opened to reach a fire alarm actuating handle, and an audio alarm triggered by opening the cover. Once triggered, pull station alarm remains on until reset using a tool or key. The pull station alarm is preferably an audio alarm contained in the pull station. The pull station alarm serves to deter false alarm setting.

In accordance with one aspect of the invention, there is provided a fire alarm pull station comprising a pull station body and a pull station cover. The pull station cover is attached to the pull station body and resides over a fire alarm actuator, wherein the pull station cover has a cover closed position preventing access to the fire alarm actuator, and the pull station cover has a cover open position allowing access to the fire alarm actuator. A latch holds the pull station body in a body closed position and the body may be opened using either a tool or a key. A pull station alarm is configured to actuate when the pull station cover moves from the cover closed position to the cover open position and may be de-actuated after opening the pull station body from the body closed position to a body open position.

In accordance with another aspect of the invention, there is provided a fire alarm pull station including a pull station body and a pull station cover. A fire alarm actuator is attached to the pull station body to actuate the fire alarm. The pull station cover is pivotally attached to the pull station body and resides over the fire alarm actuator, wherein the pull station cover has a cover closed position preventing access to the fire alarm actuator and the pull station cover has a cover open position allowing access to the fire alarm actuator. A plunger resides in the pull station body and is biased towards an extended position. The plunger is held in a retracted position by the pull station cover when the pull station cover is in the cover closed position and the plunger is released to the extended position when the pull station cover is in the cover open position. The plunger restricts moving the pull station cover from the cover open position to the cover closed position when the plunger is in the extended position. A pull station alarm is configured to actuate when the pull station cover moves from the cover closed position to the cover open position and may be de-actuated after using either a tool or a key to open the pull station body.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1B:
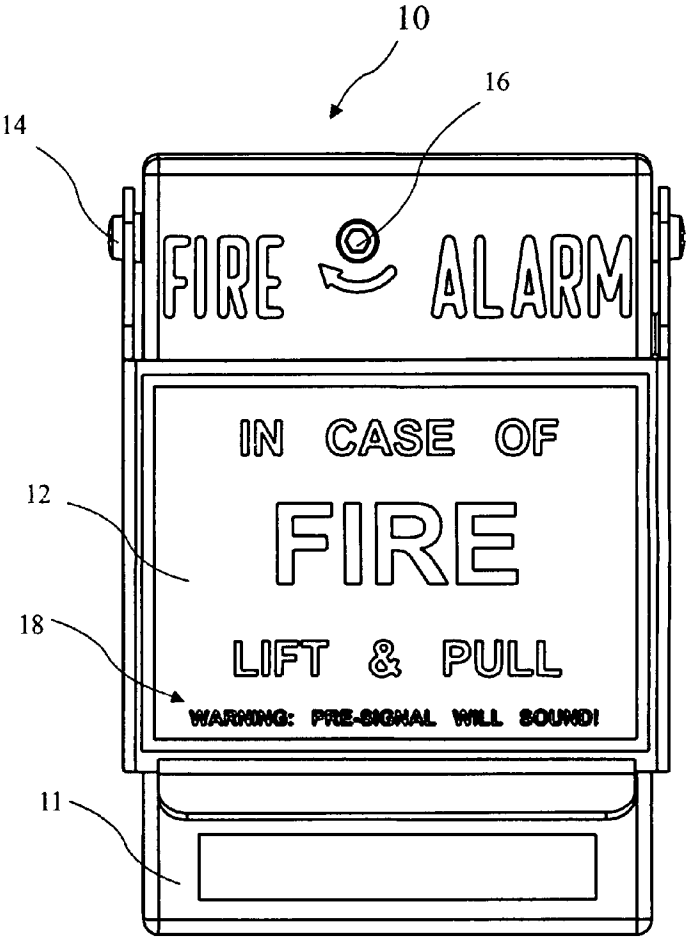
FIG. 1B is a front view of the fire alarm pull station according to the present invention.
Figure 1A:
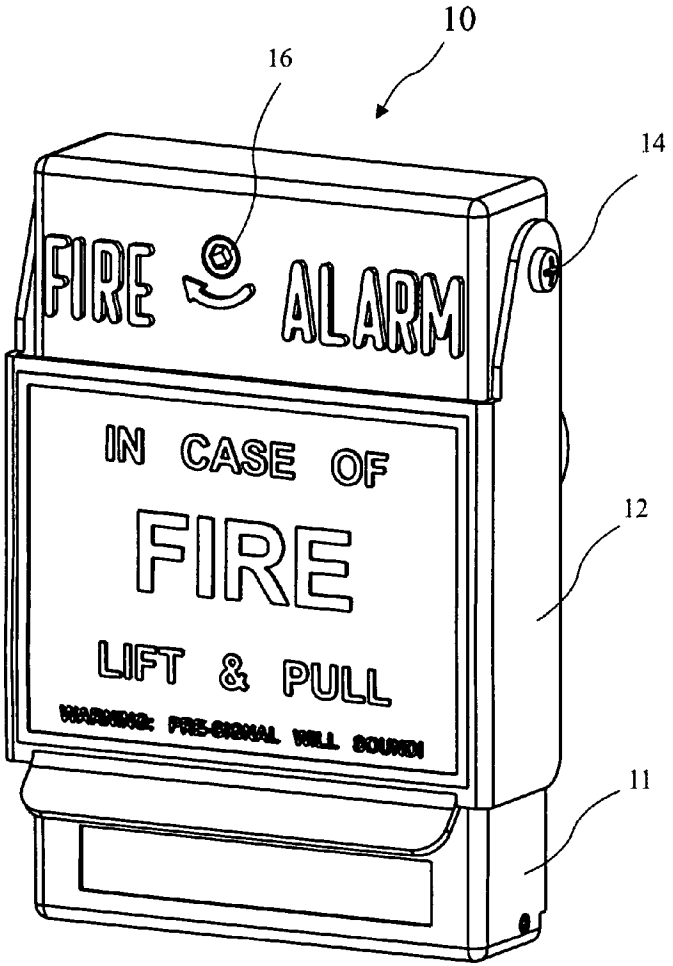
FIG. 1A is a perspective view of a fire alarm pull station according to the present invention.

A front perspective view of a fire alarm pull station 10 according to the present invention is shown in FIG. 1A, and a straight front view of the fire alarm pull station 10 is shown in FIG. 1B. The pull station 10 includes a pull station body 11 and pull station cover 12. The cover 12 is pivotally attached to the body 11 by cover pivots 14 (two cover pivots 14 reside on opposite the sides of the body 11). A lock 16 on an exposed front surface of the body 11 is provided to open the body 11 for opening the body 11. The lock 16 may be actuated by either a tool (for example an allen wrench) or a key for a key lock version 10*a* (see FIG. 9). A warning 18 is provided to warn pranksters of a pull station alarm which will sound if the cover 12 is lifted.

Figure 2:
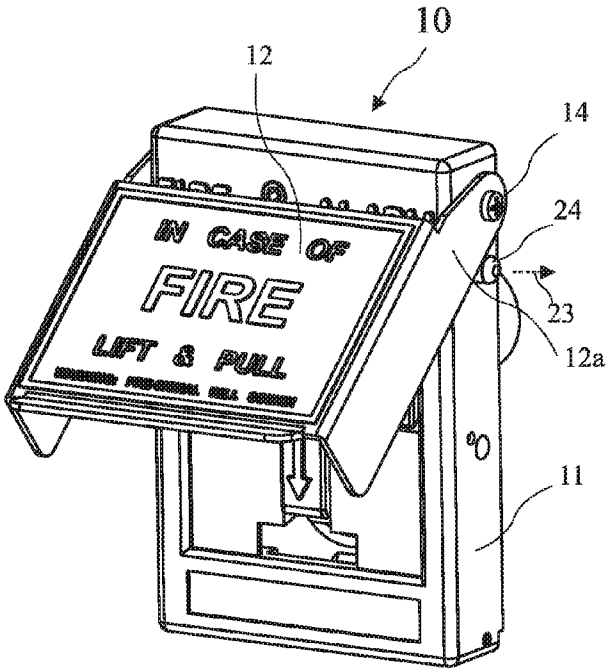
FIG. 2 depicts the pull station with a pull station cover partially open.

The pull station 10 with the pull station cover 12 partially open is depicted in FIG. 2. When the cover 12 is opened (or pivoted) about the cover pivots 14, an edge 12*a* of the cover 12 slides past a plunger 24 and the plunger 24 is released to an extended position indicated by arrow 23 orthogonal to the motion of the edge 12*a*. The plunger 24 thus extended blocks closing the cover 12. Further, the plunger 24 may be blocked from retracting into the case 11 by a pull station alarm switch 28 (see FIG. 5) which is preferably a push switch. Therefore, once the cover 12 is opened, it can not be simply closed and can not be closed without first depressing the plunger 24 orthogonally to the motion of the edge 12*a* sufficiently to allow the edge 12*a* to pass over the plunger 24.

Figure 4:
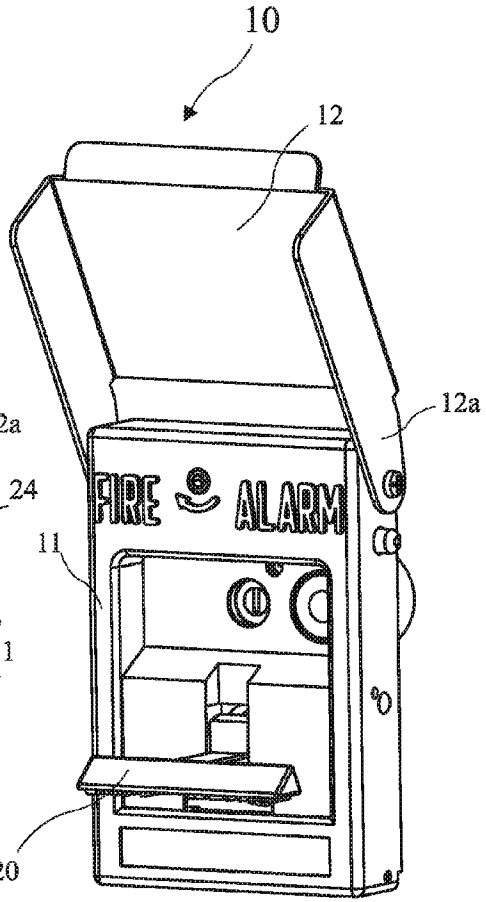
FIG. 4 depicts the pull station with the pull station cover fully open and a fire alarm handle pulled.
Figure 3:
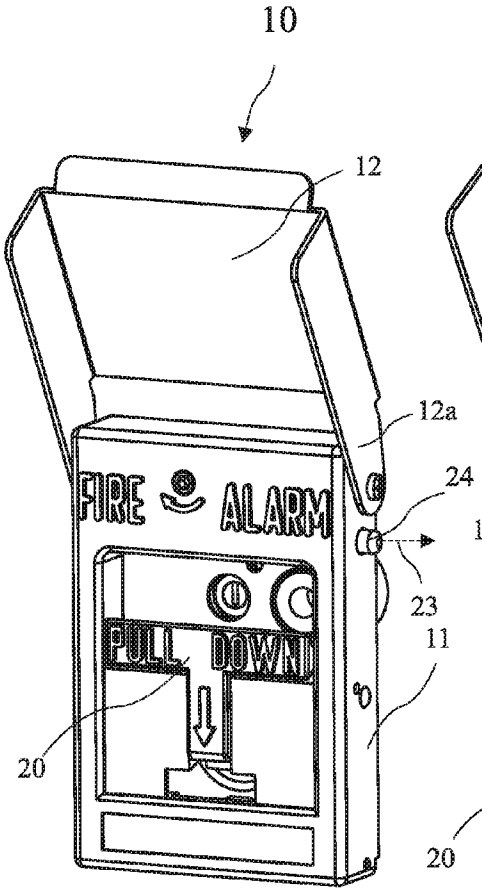
FIG. 3 depicts the pull station with the pull station cover fully open.

The pull station 10 with the pull station cover 12 fully open is depicted in FIG. 3. In the cover closed position (see FIGS. 1A and 1B), the cover 12 prevents access to a handle 20, and in the cover open position, the cover 12 allows access to the handle 20. The handle 20 cooperates with a fire alarm switch 34 (see FIG. 5) to activate the alarm bell 38 (see FIGS. 9 and 10). The pull station 10 is depicted with the pull station cover 12 fully opened and handle 20 pulled in FIG. 4.

Figure 6:
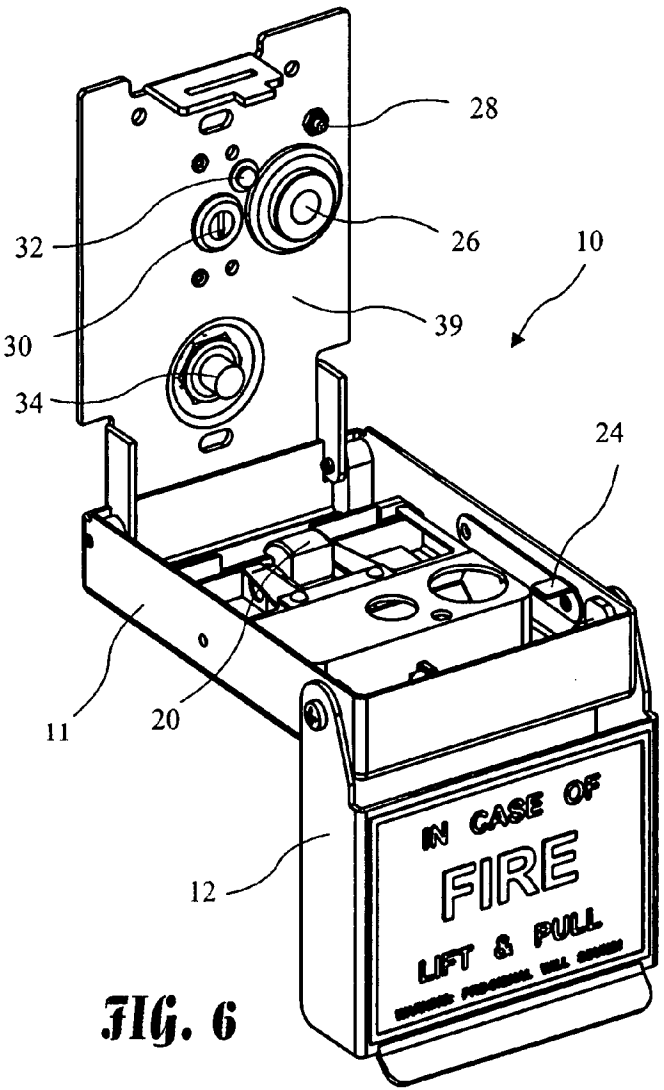
FIG. 6 is a rotated rear view of the pull station with the pull station body open.
Figure 5:
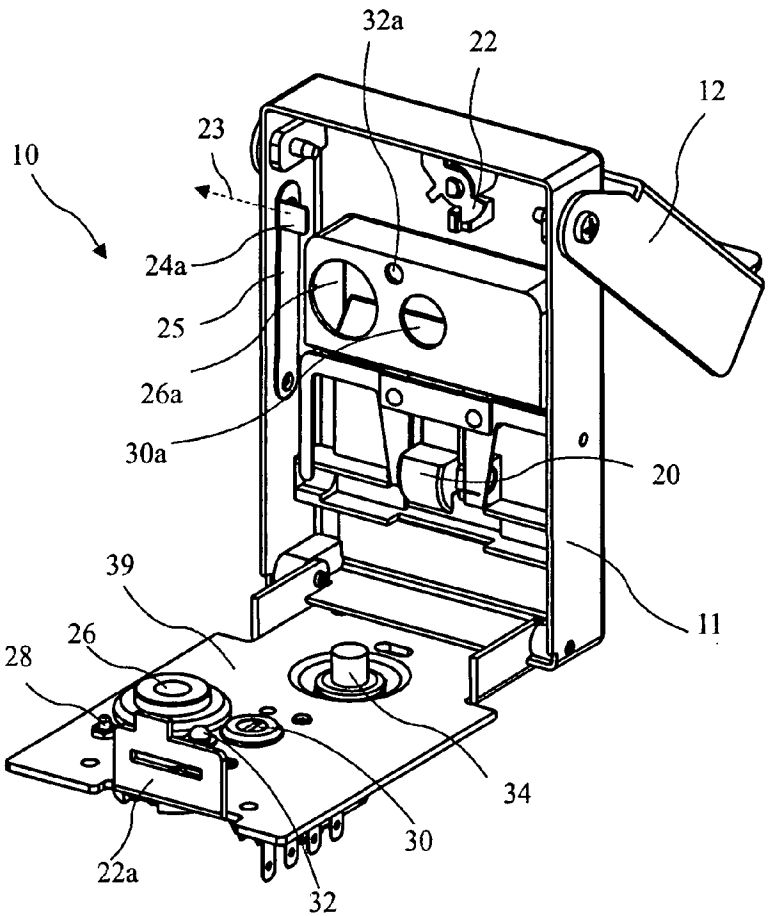
FIG. 5 is a rear view of the pull station with the pull station body open.

A rear view of the pull station 10 with the pull station body 11 opened by pivoting a back plate 39 away from the body 11 is shown in FIG. 5, and a rotated perspective rear view of the opened pull station 10 is shown in FIG. 6. The body 11 contains a switch actuator 24*a* attached to the plunger 24. The plunger 24 is urged toward an extended position indicated by the arrow 23 by a leaf spring 25, and may alternatively be urged toward the extended position by a coil spring, or any other type of spring. The switch actuator 24*a* cooperates with the pull station alarm switch 28, which is preferably a push switch, to turn on the pull station alarm when the cover 12 is opened. When the plunger 24 is in the retracted position, the switch actuator 24*a* is aligned with the pull station alarm switch 28 and urges the pull station alarm switch 28 into an OFF position. When the plunger 24 is in the extended position, the switch actuator 24*a* is displaced from the pull station alarm switch 28 and the pull station alarm switch 28 adapts an ON position.

The pull station alarm is preferably an audio alarm 26 provides a pull station alarm to deter pranksters. The audio alarm 26 may be a buzzer and preferably produces a piercing warning sound to prevent false alarm setting, and more preferably a 68/100 dB alarm measured at one foot. For example, a Peizo-A-Lert PAL-328N buzzer made by AMESCO in St. Louis, Mo. The audio alarm 26 is aligned with an alarm port 26*a* in a front face of the body 11.

A fire alarm switch 34 is attached to the back plate 39 and is actuated by the handle 20. The fire alarm switch 34 is preferably a snap action switch, for example, a model number VM0851000F200C1A switch manufactured by E-SWITCH in Brooklyn Park, Minn. Other suitable switches are the model number TMCGD6SP0040C made by C&K Industries, or a model number D3V11G1C25K made by Omron. A key switch 30 (i.e., a key operated electrical switch) is attached to the back plate 39. The key switch 30 is preferably used to turn off power to electrical elements of the pull station 10 (see FIG. 10). A key port 30*a* in the front face of the body 11 is aligned with the key switch 30 to allow turning the key switch on or off with the pull station body 11 closed. An LED 32 is attached to the back plate 39 and provides an indication that the pull station 10 is receiving power. An LED port 32*a* is provided in the front face of the body 11 to allow the LED to be seen from the front of the pull station 10. A latch 22 residing inside the body 11 is actuated by the lock 16 (see FIGS. 1A and 1B). The latch 22 cooperates with latch receiver 22*a* on the back plate 39 to lock the body 11 in a body closed position.

Figure 8:
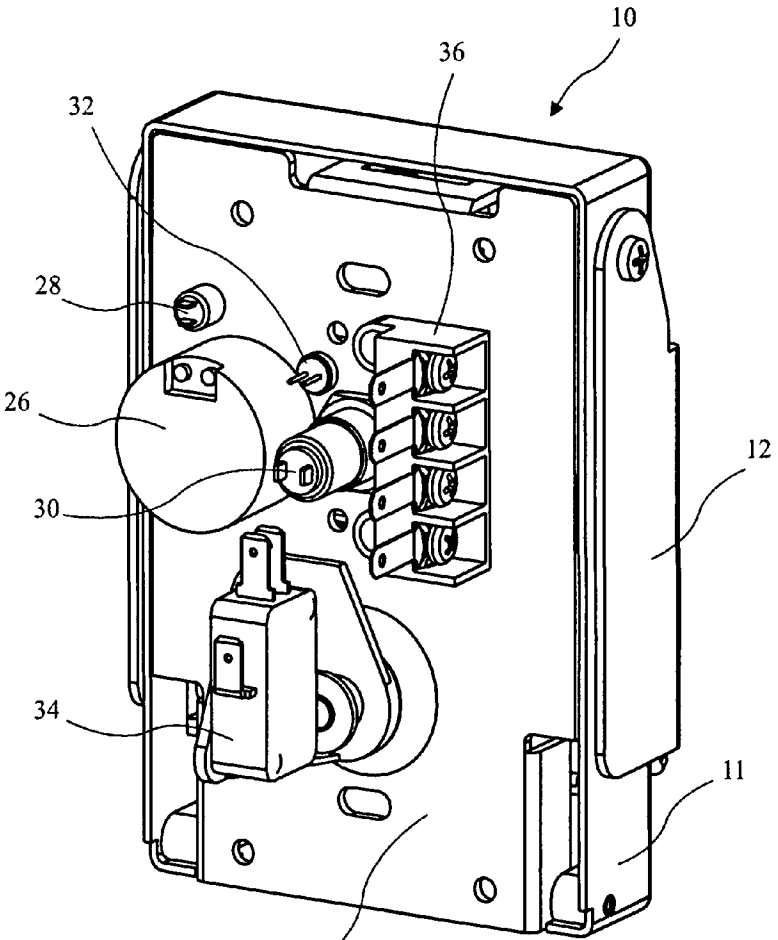
FIG. 8 is a perspective rear view of the pull station from the right rear.
Figure 7:
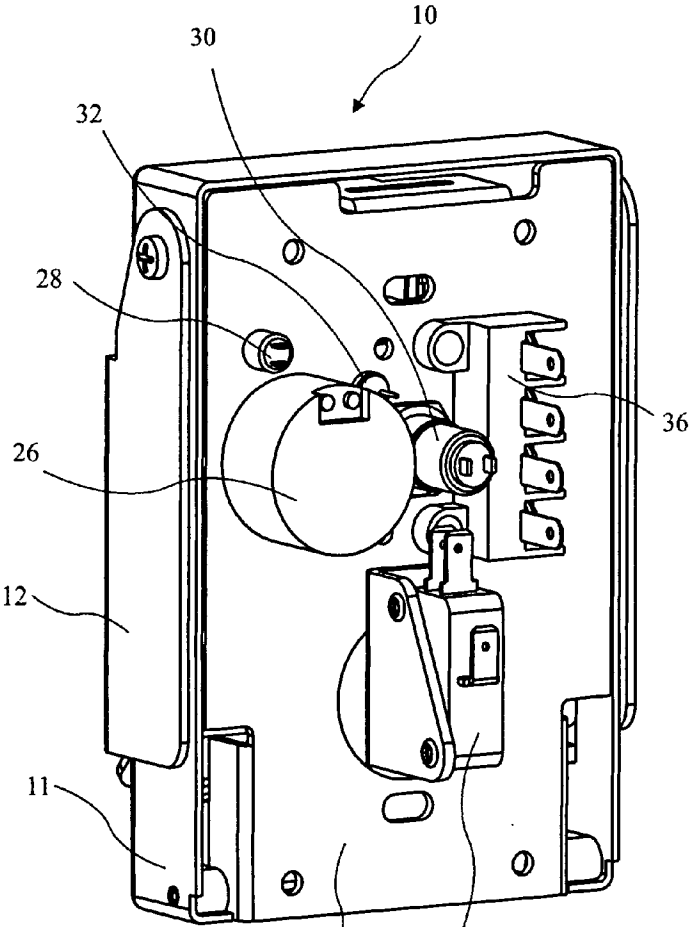
FIG. 7 is a perspective rear view of the pull station from the left rear.
Figure 9:
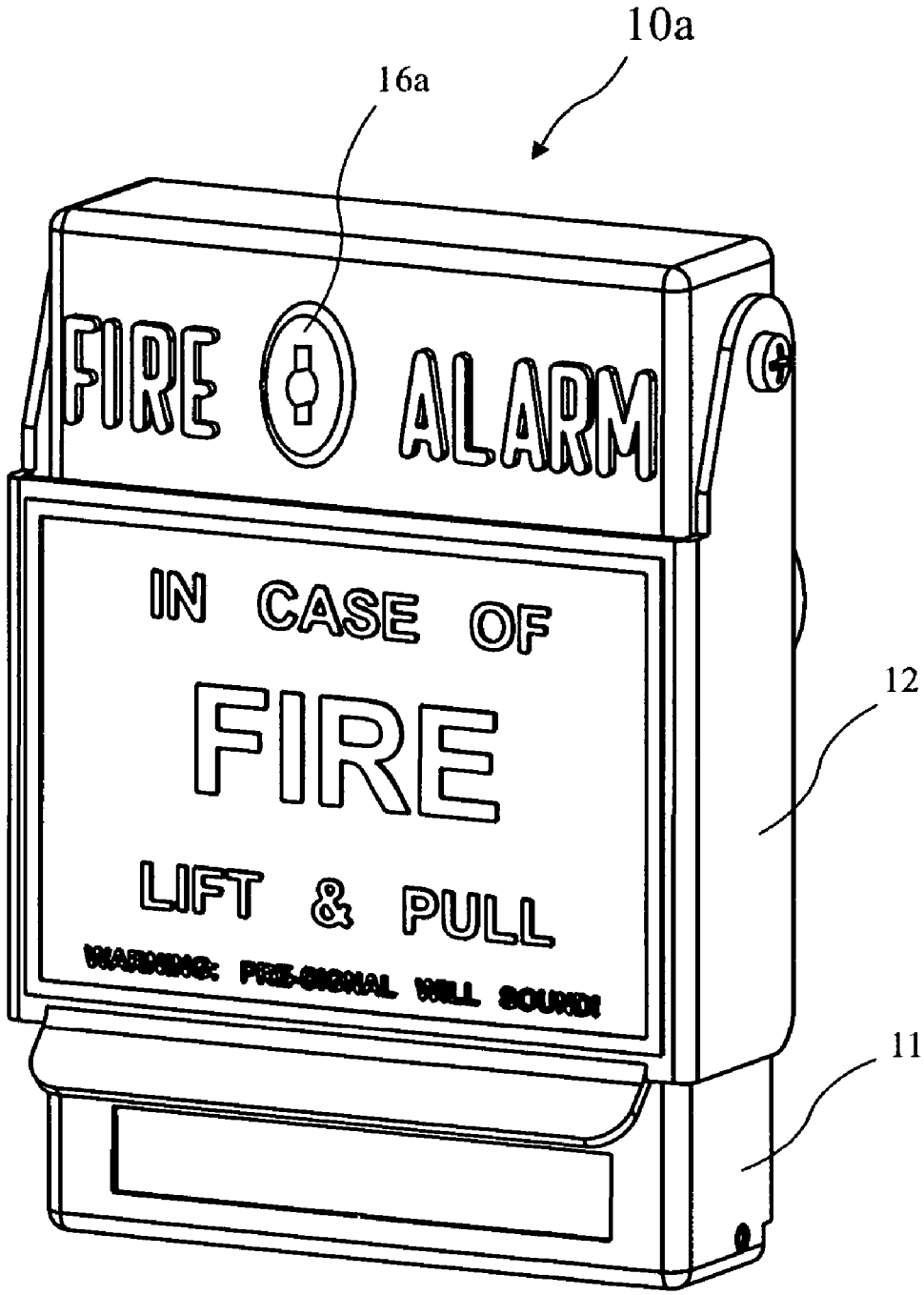
FIG. 9 is a second pull station with a key lock according to the present invention.
Figure 10:
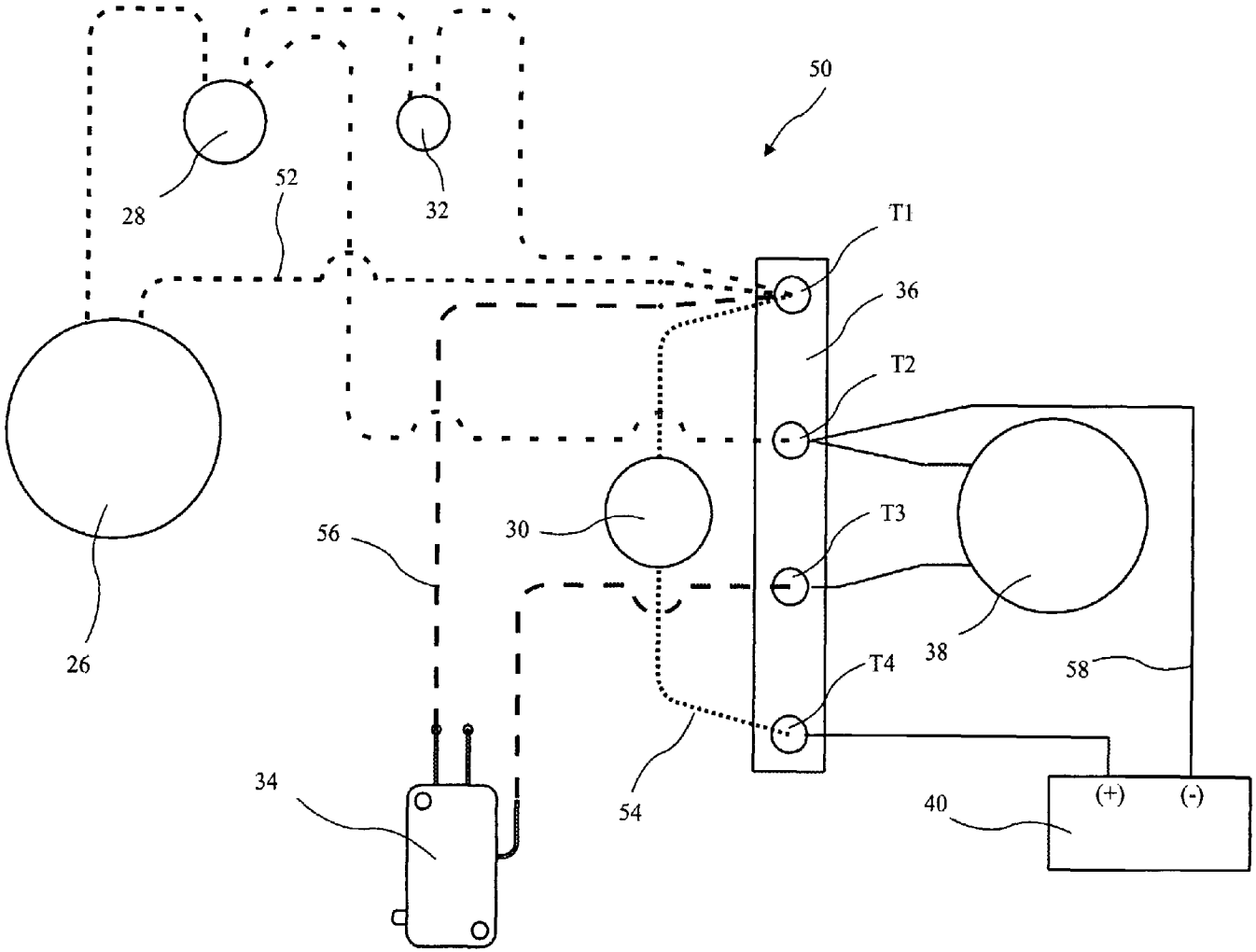
FIG. 10 is a first electrical circuit of the pull station.

A perspective rear view of the pull station 10 from the left rear is shown in FIG. 7 and a perspective rear view of the pull station 10 from the right rear is shown in FIG. 8. In each view wiring is omitted to provide a clearer illustration, which wiring is shown in FIGS. 9 and 10 below. Portions of the audio alarm 26, push switch 28, key switch 30, LED 32, and the fire alarm switch 34 are seen extending through the back plate 39. Additionally, a terminal block 36 with 4 terminals (see FIGS. 9 and 10) is mounted to a black surface of the back plate 39.

A second pull station 10*a* with a key lock 16*a* replacing the lock 16 is shown in FIG. 9. The pull station 10*a* is otherwise like the pull station 10. Further, the tool or key may directly turn off the pull station alarm without opening the pull station by actuating a switch inside the pull station.

A first electrical circuit 50 of the pull station 10 is shown in FIG. 10. Conductors 58 (shown as solid lines) carry power between a power source 40 and the terminals T2 and T4 of the terminal block 36. The key switch 30 resides between terminal T4 and T1, connected by conductors 54 (shown as dotted lines). The key switch 30 thus may disconnect (or turn off) electronic components in the pull station 10 from the power source 40. Conductors 52 (shown as short dashed line) connect the push switch 28 and buzzer 26 in series between the terminal T1 and a terminal T2. When the push switch 28 is closed (and the key switch 30 is in an ON position), power is provided to the buzzer 26 to sound the pull station alarm. Power is additionally provided through the conductors 52 to the LED 32 when ever the key switch 30 is on.

An alarm bell circuit is connected by conductors 56 (shown as long dashed lines) connecting the fire alarm switch 34 between terminals T1 and T3. The alarms bell 38 is connected between terminal T2 (i.e., is connected directly to the power source 40) and terminal T3. The alarm circuit 50 is a preferred circuit when there is access to two wires from the power source 40 and access to two wires from the alarm bell 38.

Figure 11:
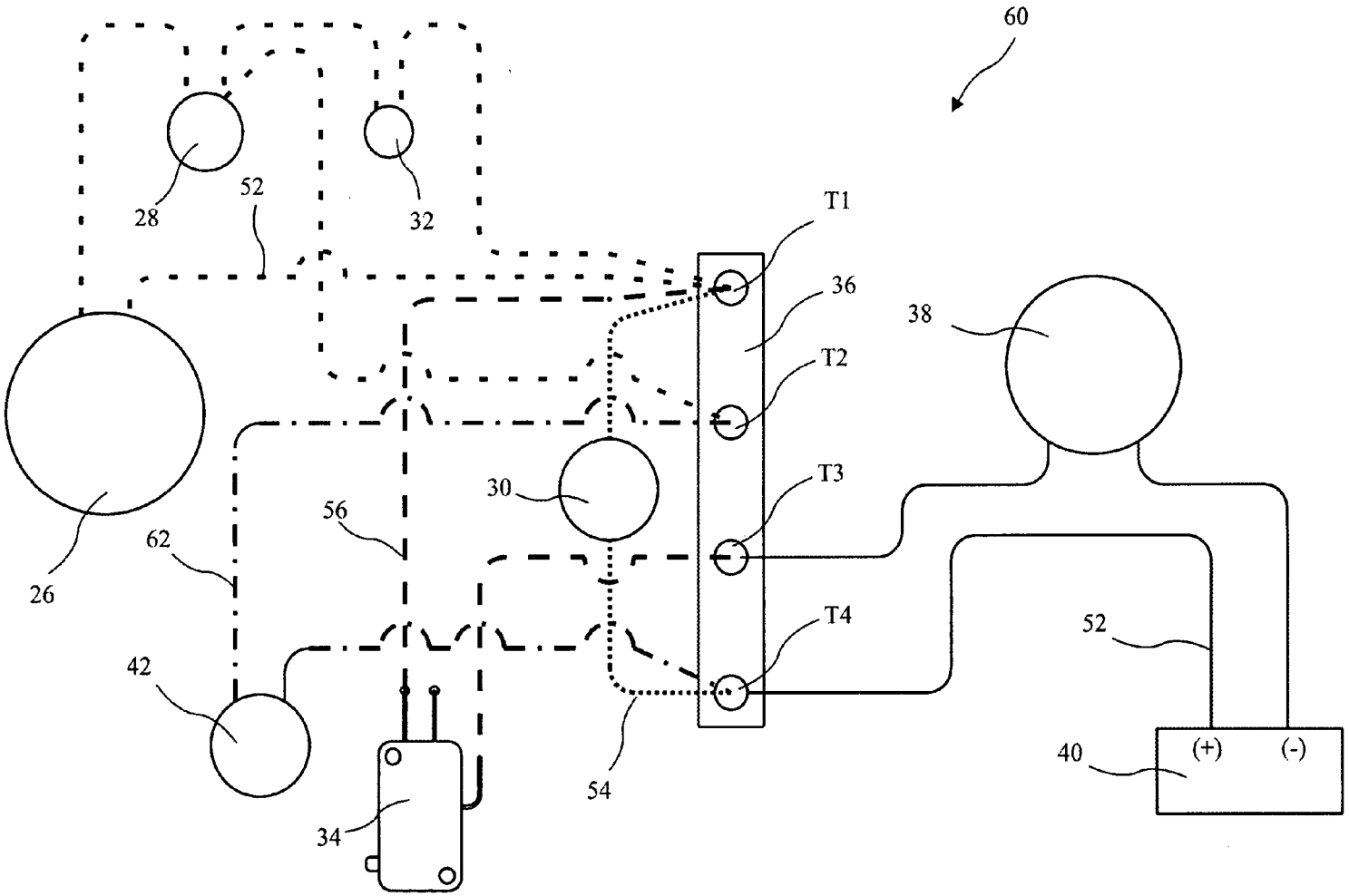
FIG. 11 is a second electrical circuit of the pull station.

A second electrical circuit 60 of the pull station 10 is shown in FIG. 11. A battery 42 is connected between the terminal T4 and the terminal T2, thus providing a power source to the pull station 10, for example, when the pull station is a wireless pull station. The key switch 30 resides between terminal T4 and T1, connected by conductors 54 (shown as dotted lines). Conductors 52 (shown as short dashed line) connect the push switch 28 and buzzer 26 in series between the terminal T1 and the terminal T2. When the push switch 28 is closed (and the key switch 30 is in an ON position), battery power is provided to the buzzer 26 to sound the pull station alarm. Battery power is additionally provided through the conductors 52 to the LED 32 when ever the key switch 30 is on.

A second alarm bell circuit is connected by conducts 56 (shown as long dashed lines) serially connecting the fire alarm switch 34 between terminals T1 and T3. Thus, when the key switch 30 is in an ON position, and the fire alarm switch 34 is closed (or on), a circuit is closed between the terminals T3 and T4. The power source 40 is connect by the conductors 52 (shown as solid lines) to terminals T3 and T4 of the terminal block 36, and the alarm bell 38 and the power source 40 are serially connected between the terminal T3 and the terminal T4. Therefore, when the key switch 30 is on, and the fire alarm switch 34 is closed, a circuit is completed between the alarm bell 38 and the power source 40. In the case of a wireless pull station, closing the circuit between the terminals T3 and T4 causes an alarm signal to be transmitted to a separate alarm bell circuit. The conductors 52, 54, 56, 58, and 62 are preferably electrical wires. The alarm circuit 60 is a preferred circuit when there is access to one wire from the power source 40 and access to one wire from the alarm bell 38.

Figure 12:
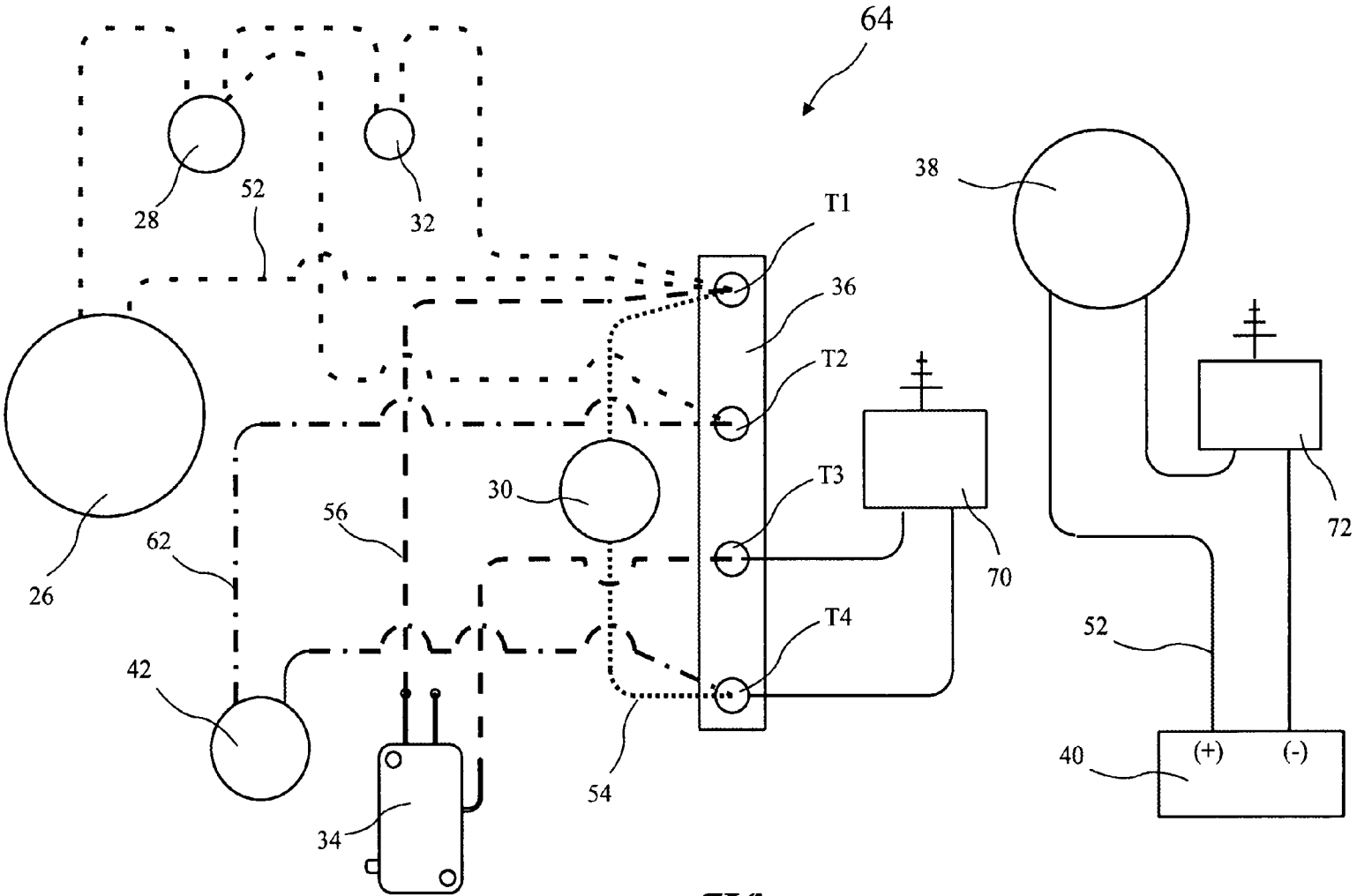
FIG. 12 shows elements of a first wireless alarm circuit.

Elements of a first wireless alarm circuit 64 are shown in FIG. 12. The circuit 64 is similar to the circuit 60 (see FIG. 11) with the exception that a transmitter 70 is connected between the terminals T3 and T4 replacing the alarm bell 38 and power source 40 in-series connected in-series between the terminals T3 and T4. The alarm bell 38 and power source 40 comprise an alarm bell circuit including a receiver 72 for receiving wireless signals from the transmitter 70.

While the invention herein disclosed has been described by means of specific embodiments and applications thereof, numerous modifications and variations could be made thereto by those skilled in the art without departing from the scope of the invention set forth in the claims.

We claim:

1. A fire alarm pull station comprising:

a pull station body;

a fire alarm switch switching an electrical signal to actuate a fire alarm and residing in the pull station body;

a handle accessible and user actuatable from the exterior of the pull station body to actuate the fire alarm switch;

a pull station cover attached to the pull station body and residing over the handle, wherein the pull station cover has a cover closed position preventing access to the handle, and the pull station cover has a cover open position allowing access to the handle;

a cover latch biased to engage the pull station cover when the pull station cover is opened to prevent closing the pull station cover, the cover latch disengagable from the pull station cover to allow the pull station cover to be closed, the disengaging of the latch cover from the pull station cover requiring using one selected from a tool and a key; and a pull station alarm configured to actuate when the pull station cover moves from the cover closed position to the cover open position and configured to require at least one of a set consisting of a tool and a key to de-actuate.

2. The fire alarm pull station of claim 1, wherein the pull station cover is pivotally attached to the pull station body.

3. The fire alarm pull station of claim 2, wherein:

the cover latch comprises a plunger residing in the pull station body and is biased in a first direction towards an extended position;

the plunger is held in a retracted position by the pull station cover when the pull station cover is in the cover closed position;

the plunger is released to move in the first direction to the extended position when the pull station cover is moved in a second direction not aligned with the first direction, to place the cover in the cover open position; and the plunger blocks moving the pull station cover from the cover open position to the cover closed position when the plunger is in the extended position and the plunger must be returned to the retracted position before the cover may be closed.

4. The fire alarm pull station of claim 3, further including:

a pull station alarm switch; and a switch actuator attached to the plunger, wherein:

the pull station alarm is actuated by the pull station alarm switch;

when the plunger is in the retracted position, the switch actuator holds the pull station alarm switch in an OFF position; and when the plunger is in the extended position, the switch actuator releases the pull station alarm switch to an ON position.

5. The fire alarm pull station of claim 4, wherein when in the ON position, the pull station alarm switch blocks the return of the plunger to the retracted position.

6. The fire alarm pull station of claim 5, wherein the pull station alarm switch is a push switch.

7. The fire alarm pull station of claim 4, wherein:

the pull station body is held in a body closed position by a latch;

the pull station body may be opened to a body open position by releasing the latch using at least one of the set consisting of the tool and the key; and the plunger may be returned to the retracted position when the pull station body is in the body open position.

8. The fire alarm pull station of claim 7, further including a back plate pivotally attached to the pull station body, wherein:

the back plate and pull station body are held in the body closed position by the latch; and the back plate and pull station body may be opened to the body open position by releasing the latch using at least one of the set consisting of the tool and the key.

9. The fire alarm pull station of claim 1, wherein the pull station alarm comprises a buzzer residing in the pull station body.

10. The fire alarm pull station of claim 1, wherein the pull station alarm comprises a piercing warning horn residing in the pull station body.

11. The fire alarm pull station of claim 1, wherein the pull station includes a key switch configured to turn off power to electronic components in the pull station.

12. The fire alarm pull station of claim 1, wherein the pull station includes a battery providing power to pull station electronic components.

13. The fire alarm pull station of claim 1, wherein the pull station actuator is a handle.

14. The fire alarm pull station of claim 1, wherein the pull station actuator cooperates with a snap action switch to actuate the fire alarm.

15. A fire alarm pull station comprising:

a pull station body;

a latch for holding the pull station body in a body closed position, the latch openable by at least one of a set consisting of a tool and a key;

a fire alarm switch switching an electrical signal to actuate a fire alarm and residing in the pull station body;

a handle attached to the pull station body to actuate the fire alarm switch;

a pull station cover attached to the pull station body and residing over the handle, wherein the pull station cover has a cover closed position preventing access to the handle and the pull station cover has a cover open position allowing access to the handle;

a cover latch having an engaged position in which the cover latch engages the pull station cover when the pull station cover is opened to prevent closing the pull station cover, the cover latch disengagable to allow the cover to be closed;

a pull station alarm switch actuated by the cover latch when the cover latch moves to the engaged position; and a pull station alarm actuated by the pull station alarm switch.

16. A fire alarm pull station comprising:

a pull station body;

a fire alarm switch switching an electrical signal to actuate a fire alarm and residing in the pull station body;

a handle attached to the pull station body to actuate the fire alarm switch;

a pull station cover pivotally attached to the pull station body and residing over the handle, wherein the pull station cover has a cover closed position preventing access to the handle and the pull station cover has a cover open position allowing access to the handle;

a plunger residing in the pull station body and biased towards an extended position, wherein:

the plunger is blocked in a retracted position by an edge of the pull station cover when the pull station cover is in the cover closed position with the edge residing over the plunger;

the plunger is released to the extended position when the edge of the pull station cover is moved past the plunger and the pull station cover is moved to the cover open position; and the plunger blocks moving the pull station cover from the cover open position to the cover closed position when the plunger is in the extended position and the cover can not be closed without first depressing the plunger 24 orthogonally to the motion of the cover sufficiently to allow the edge of the pull station cover to pass over the plunger 24; and a pull station alarm configured to actuate when the pull station cover moves from the cover closed position to the cover open position and configured to require at least one of a set consisting of a tool and a key to de-actuate.

* * * * *